US007819669B2

(12) United States Patent
Liao et al.

(10) Patent No.: US 7,819,669 B2
(45) Date of Patent: Oct. 26, 2010

(54) LAND GRID ARRAY CONNECTOR

(75) Inventors: Fang-Chu Liao, Tu-cheng (TW); Shuo-Hsiu Hsu, Tu-cheng (TW); Chun-Yi Chang, Tu-cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 285 days.

(21) Appl. No.: 12/077,152

(22) Filed: Mar. 17, 2008

(65) Prior Publication Data

US 2008/0227309 A1 Sep. 18, 2008

(30) Foreign Application Priority Data

Mar. 16, 2007 (CN) ..... 2007 2 0035420

(51) Int. Cl.
*H01R 12/00* (2006.01)

(52) U.S. Cl. ..... 439/66; 439/71

(58) Field of Classification Search ..... 439/66, 439/71

See application file for complete search history.

(56) References Cited

U.S. PATENT DOCUMENTS 6,679,707 B1 1/2004 Brodsky et al.
6,881,073 B2 * 4/2005 Bali et al. ..... 439/70
7,037,113 B2 * 5/2006 Soh ..... 439/66
7,118,401 B2 10/2006 McHugh et al.
7,160,115 B2 * 1/2007 Huang et al. ..... 439/66
7,196,907 B2 * 3/2007 Zheng ..... 361/760
2006/0094266 A1 * 5/2006 Liao et al. ..... 439/71
2006/0172563 A1 * 8/2006 Soh ..... 439/66
2010/0041253 A1 * 2/2010 Hashimoto et al. ..... 439/66

* cited by examiner

*Primary Examiner*—Gary F. Paumen
(74) *Attorney, Agent, or Firm*—Andrew C. Cheng; Wei Te Chung; Ming Chieh Chang

(57) ABSTRACT

A land grid array (LGA) connector, for electrically connecting an IC (Integrated Circuit) package to a printed circuit board, comprises a retaining frame, a plurality of sections mounted on the retaining frame and a plurality of contacts received in the sections. Each contact having a contacting portion extending beyond the top surface of the section to contact with the IC package, and the contacting portions of the contacts received in a same section have two opposed extending direction to evenly and elastically support the IC package when the IC package is pressed toward the contacts.

15 Claims, 5 Drawing Sheets

LAND GRID ARRAY CONNECTOR

BACKGROUND OF THE INVENTION

1. Field of the Invention

The present invention relates to a connector, especially to a land grid array (LGA) connector for electrically connecting a semiconductor package to a printed circuit board.

2. Description of the Related Art

U.S. Pat. No. 6,679,707 discloses a land grid array (LGA) connector, the LGA connector has four sections, a retaining frame for supporting the sections and a plurality of column-shape contacts received in the section. Each contact passes through a top and a bottom surfaces of a corresponding section, and has two opposed ends which are respectively formed with a contacting portion to electrically contact with an IC (Integrated Circuit) package and a soldering portion to be soldered to a printed circuit board on which the LGA connector is mounted. Usually, the IC package and the printed circuit board respectively have a film of oxide, and the films of oxide can be scraped off by the contacts, so that the IC package and the printed circuit board can electrically connect with each other. However, the contacts of the connector only elastically press the IC package and the printed circuit board in a vertical direction to conduct the IC package and the printed circuit board, so the films of oxide may not be effectively scraped, that will influence a connecting performance of the IC package and the printed circuit board.

An improved connector has "[" shape contacts, each contact is formed with a contacting portion at a top end thereof, all the contacting portions extend toward to a same direction, so when IC package is pressed downwardly to press the contacts, since elastic counter forces exerting by the contacting portions of the contacts on the IC package are toward the same direction, so the IC package is unbalanced and may occur an excursion toward this direction, that may cause that the contacting portions of the contacts can not exactly contact with conductive pads of the IC package.

Hence, an improved connector is required to overcome the disadvantages of the prior art.

SUMMARY OF THE INVENTION

An object of the invention is to provide a connector which can evenly support an IC (Integrated Circuit) package.

To achieve the above-mentioned object, a connector comprises: a plurality of sections, each section defining a plurality of receiving slots passing through a top and a bottom surfaces thereof; and a plurality of contacts received in the receiving slots of the sections, each contact having a contacting portion extending beyond the top surface of the section, and the contacting portions of the contacts received in a same section having two opposed extending directions.

Other features and advantages of the present invention will become more apparent to those skilled in the art upon examination of the following drawings and detailed description of preferred embodiments, in which:

DETAILED DESCRIPTION OF PREFERRED EMBODIMENT

Figure 1:
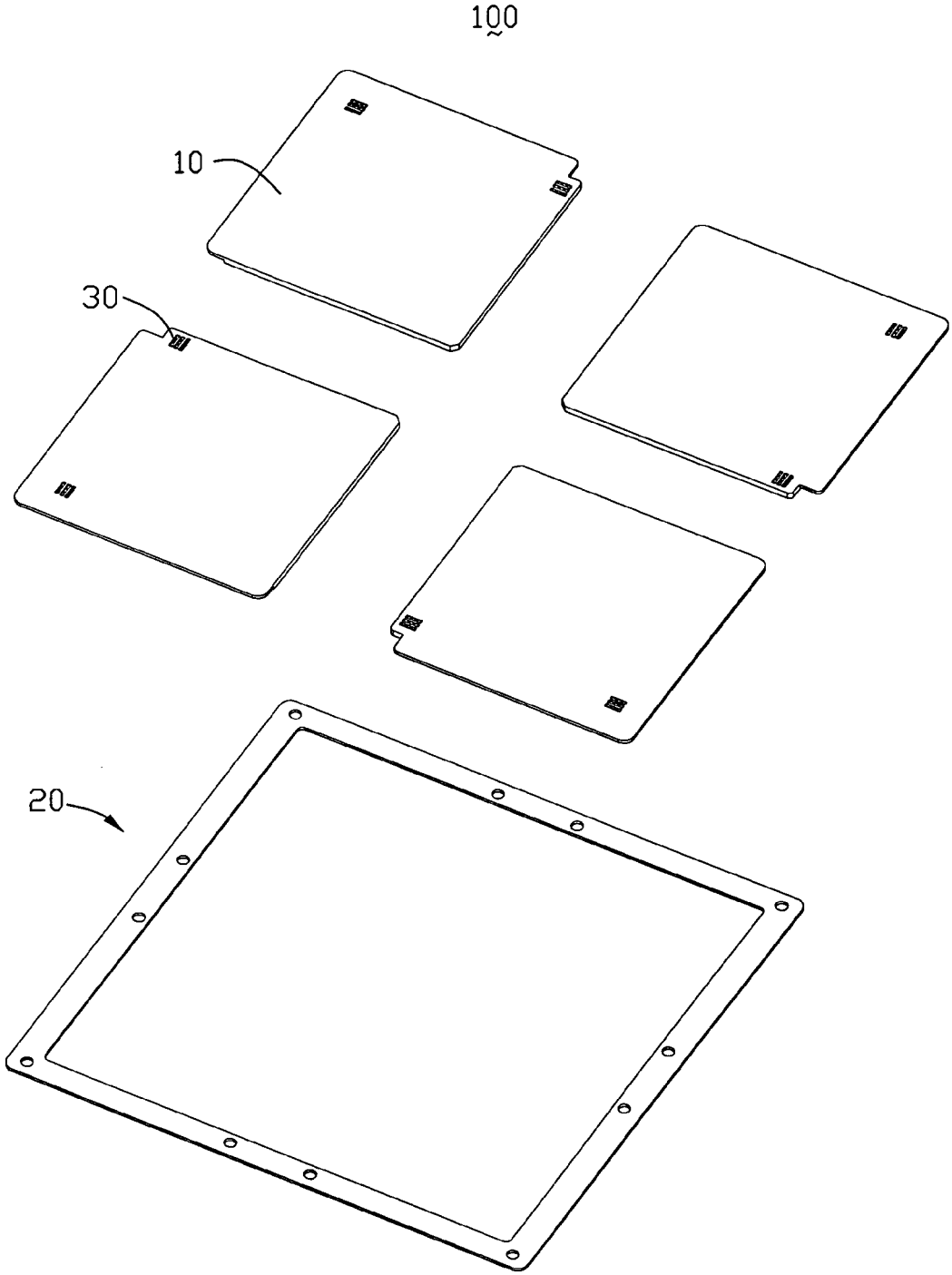
FIG. 1 is an exploded sketch map of a connector according to an embodiment of present invention.
Figure 2:
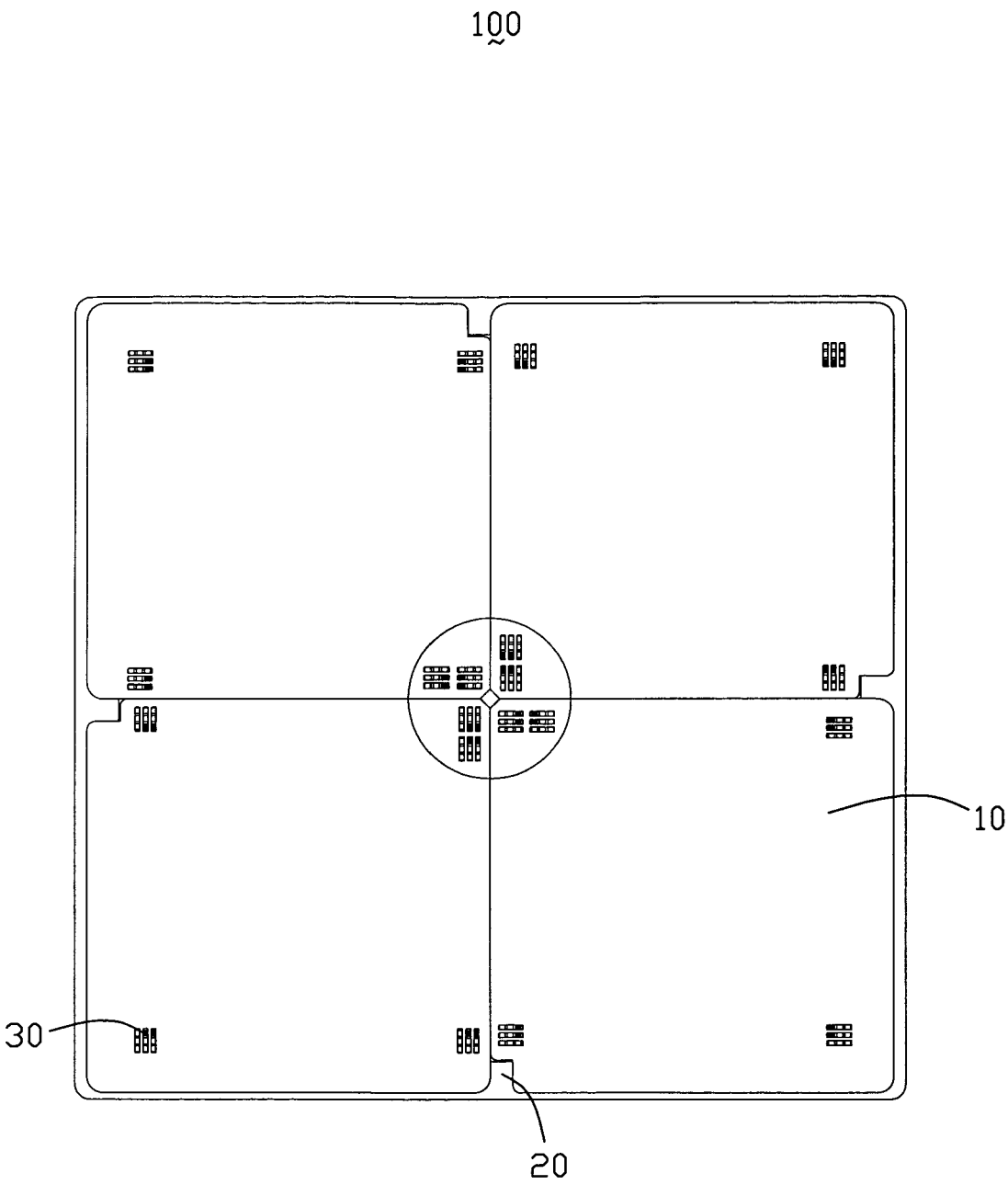
FIG. 2 is an assembled, plan sketch map of the connector.

Reference will now be made in detail to the preferred embodiment of the present invention.

Referring to FIGS. 1-5, a connector 100, adapted for electrically connect an IC package (not shown) and a printed circuit board (not shown), comprises four sections 10 with same configures and a retaining frame 20 for supporting the sections 10. Each section 10 receives a plurality of contacts 30. Additionally, FIGS. 1-5 only show a part of the contacts 30 to illuminate the preferred embodiment of the present invention.

The section 10 is approximately in a quadrate shape and has a conductive part 11 and an edge part 12. The conductive part 11 defines a plurality of receiving slots 111 aligned in matrix, each receiving slot 111 passes through a top and a bottom surfaces of the section 10 and receives a corresponding contact 30; the conductive part 11 has four side portions 112, the edge part 12 is extending outwardly from two adjacent side portions 112, and forms a step between the conductive part 11. The side portion 112 has a plurality of latching portions 113, and the edge part 12 has a plurality of pins 121.

The retaining frame 20 is stamped from a metal piece and has an opening (not labeled) in the center thereof. The retaining frame 20 further defines a plurality of through holes 21 for receiving the pins 121 of the sections 10.

Figure 3:
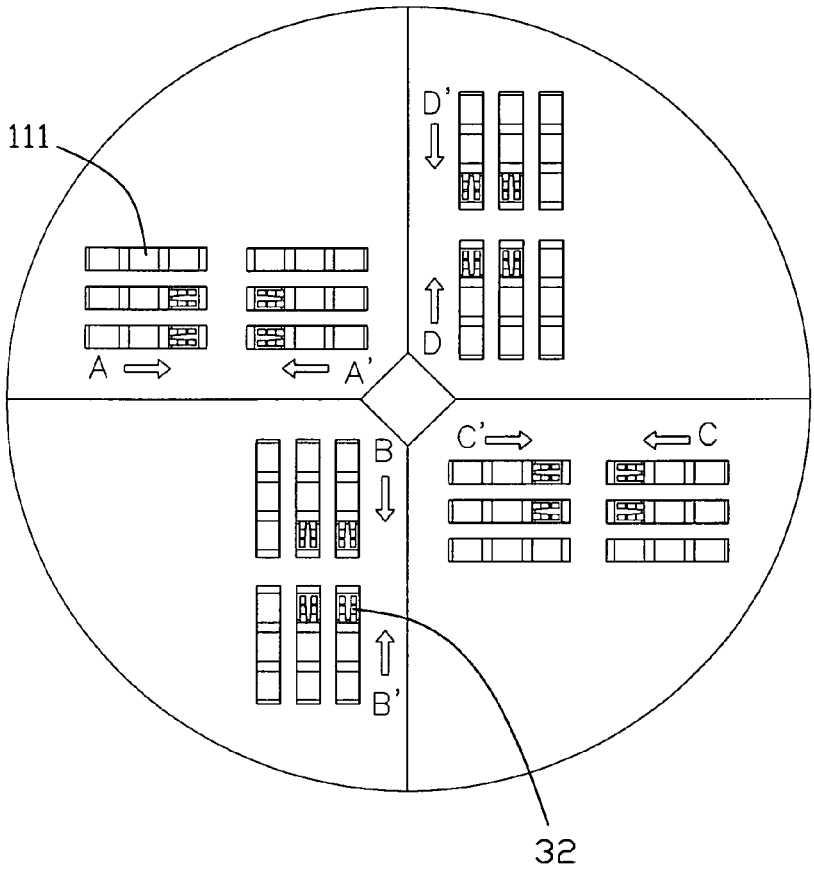
FIG. 3 is an enlarged view of a circled portion of FIG. 2.
Figure 4:
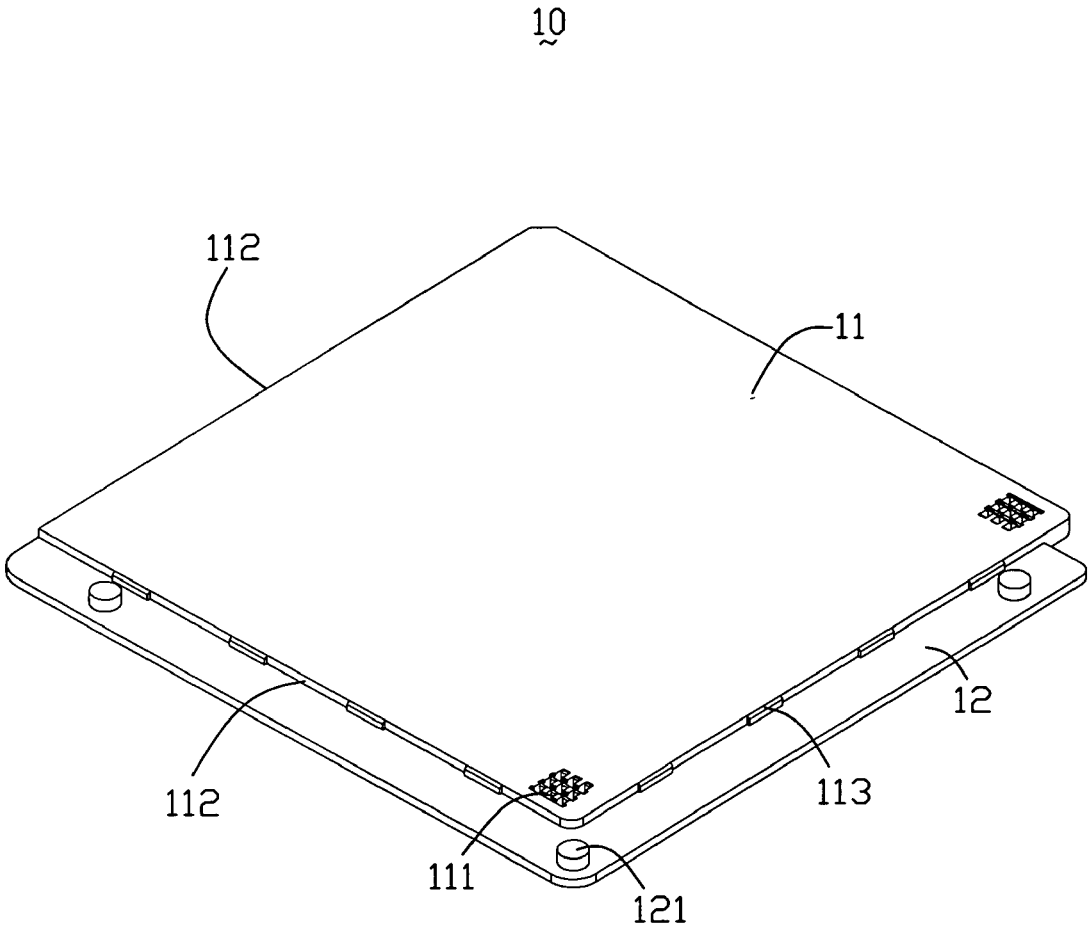
FIG. 4 is a perspective view of a section of the connector.
Figure 5:
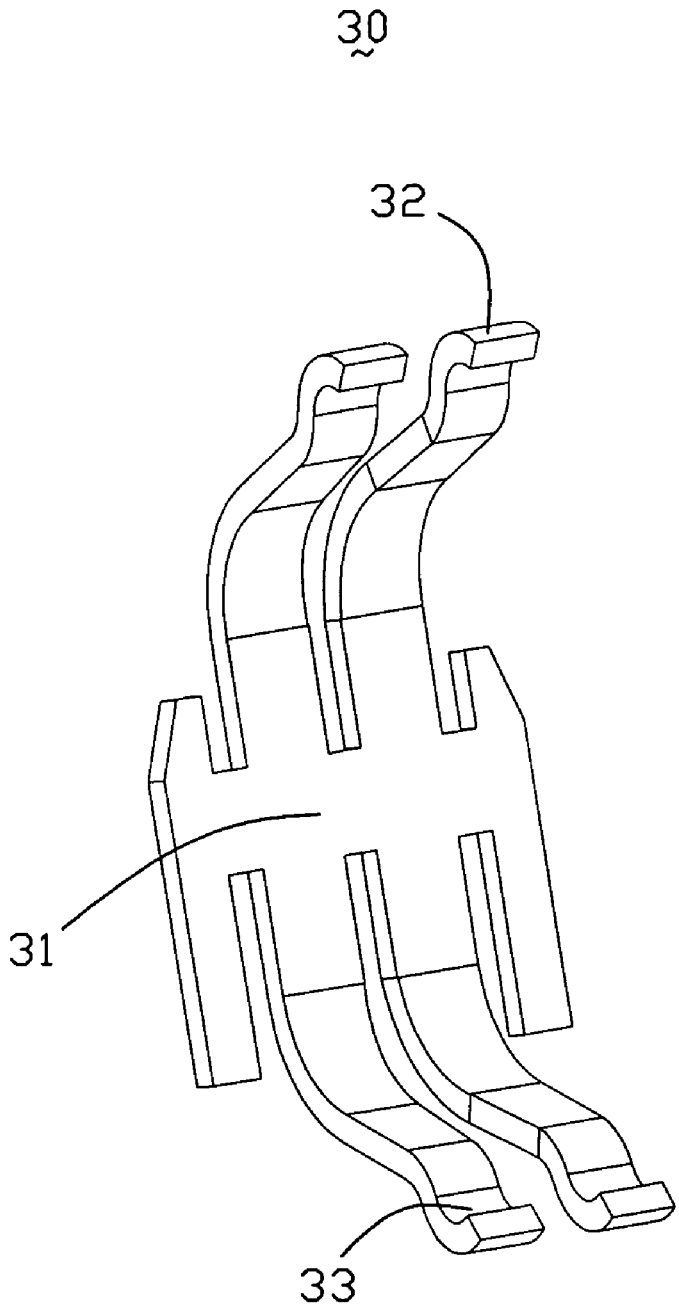
FIG. 5 is a perspective view of a contact of the connector.

The contact 30 is approximately in a "[" shape, and comprises a upright main body 31, a contacting portion 32 and a mounting portion 33 respectively bended from two opposed ends of the main body 31. The contacts 30 have two array ways when being inserted to the section 10, the contacting portions 32 of two contacts 30 which are inserted into the section 10 in different ways, extend toward two opposed directions. So when the IC package (not shown) presses the contacts 30 received the section 10, the IC package (not shown) will be acted by two different forces toward opposed directions provided by the contacts 30 of each section 10. Referring to FIG. 3, in a counter-clock-wise direction, the four sections 10 have four pairs opposed directions: A-A', B-B', C-C' and D-D'.

When assembly, firstly, the contacts 30 are inserted into the receiving slots 111 of the sections 10; then one of the sections 10, regarded as a first section 10, is set upon the retaining frame 20, with the pins 121 inserting into the through holes 21 of the retaining frame 20, the edge part 12 of the first section 10 is supported by a top surface of the retaining frame 20, and the latching portions 13 of the first section 10 engage with inner sidewalls of the retaining frame 20. After that, another section 10, regarded as a second section 10, is turned right to be formed at a right angle to first section 10 and then is set upon the retaining frame 20 and adjacent to the first section 10, so that the extending directions of the contacting portions 32 of the contacts 30 in the second section 10 are vertical to that of the contacts 30 in the first section 10. In a same assembly manner, the rest two sections 10 are set on the retaining frame 20, and the extending directions of the contacting portions 32 of the contacts 30 on each section 10 are vertical to that of the contacts 30 on two adjacent sections 10.

In use, the assembled connector 100 is mounted to the printed circuit board (not shown), the mounting portions 33 of the contacts 30 electrically and elastically touch the printed circuit board, the IC package (not shown) is put upon the connector 100 to electrically and elastically touch the contacting portion 32 of the contacts 30, so the IC package electrically connects with the printed circuit board (not shown). The contacting portions 32 and the mounting portions 33 of the contacts 30 wipe the films of oxide on the IC package (not shown) and the printed circuit board (not shown) during a using process. Furthermore, since the contacts 30 received each section 10 have two opposed extending directions, and four same sections 10 are arranged in a clockwise direction and the extending directions of the contacting portion 32 of the contact 30 received in each section are vertical to that of the contacts 30 received in adjacent two sections 10, so the IC package (not shown) can get a balanced outside force from the contact 30 when being pressed to the contacts 30 for connecting with the connector 100.

While the present invention has been described with reference to preferred embodiments, the description of the invention is illustrative and is not to be construed as limiting the invention. Various of modifications to the present invention can be made to preferred embodiments by those skilled in the art without departing from the true spirit and scope of the invention as defined by the appended claims.

What is claimed is:

1. A connector comprising:

four same sections, each section defining a plurality of receiving slots passing through a top and a bottom surfaces thereof; and a plurality of contacts received in the receiving slots of the sections, each contact having a contacting portion extending beyond the top surface of the section, and the contacting portions of the contacts received in a same section having two opposed extending directions; wherein the four same sections are arranged in a clock-wise direction or in a counter-clock-wise direction, so the two opposed extending directions of the contacts received in each section are normal to that of the contacts received in two adjacent sections.

2. A connector as described in claim 1, wherein each contact has a main body received in corresponding receiving slot, and a mounting portion bent from a bottom end of the main body and the contacting portion bent from a top end of the main body.

3. A connector as described in claim 2, wherein the mounting portion extends toward a same direction with the contacting portion of the contact.

4. A connector as described in claim 3, further comprising a retaining frame defining an opening in a center thereof, the section has a conductive part and an edge part being around the conductive part and being supported by the retaining frame.

5. A connector as described in claim 4, wherein the conductive part and the edge part of the section form a step therebetween.

6. A connector as described in claim 5, wherein the section is formed with a plurality of latching portions on the edge part for engaging with the retaining frame.

7. A land grid array (LGA) connector, adapted for connecting an IC package to a printed circuit board, comprising:

four sections, each section defining a plurality of receiving slots which pass through a top and a bottom surfaces thereof; and a plurality of contacts received in the receiving slots of the sections, each contact formed with a contacting portion having an extending direction, and the extending direction of the contact received in one of the section being normal to that of the contacts received in two adjacent sections.

8. A connector as described in claim 7, wherein the four sections have a same configure and are arranged in a clockwise direction or in a counter-clock-wise direction.

9. A connector as described in claim 7, wherein the contacting portions of the contacts received in a same section have two opposed extending directions.

10. A connector as described in claim 9, wherein the contact has a main body received in the receiving slot, the contacting portion and a mounting portion extending from a bottom end of the main body toward a same direction with the contacting portion.

11. A connector as described in claim 10, further comprising a retaining frame defining an opening in a center thereof, the section has a conductive part and an edge part around the conductive part, the retaining frame supports the edge part of the section.

12. A connector as described in claim 11, wherein the conductive part and the edge part of the section form a step therebetween.

13. A connector as described in claim 12, wherein the edge part is formed with a plurality of latching portions for engaging with the retaining frame.

14. A connector comprising:

four housing units each neighboring respectively with two other housing units along neighboring edges adjacent and perpendicular to each other, and further diagonally neighboring with another housing unit;

each housing unit being equipped with a plurality of contacts which are arranged with pairs to counterbalance the reaction forces; wherein a contact extension direction of each housing unit is perpendicular to those in said two other housing units along said neighboring edges while same with the diagonally neighboring housing unit.

15. A connector as claimed in claim 14, wherein the neighboring edges of said four housing units form a cross.

* * * * *